US005704540A

United States Patent [19]

Coalier et al.

[11] Patent Number: 5,704,540

[45] Date of Patent: Jan. 6, 1998

[54] CARTON OR CARTON COVER OF RIGID SHEET MATERIAL WITH HANDLE

[75] Inventors: Guy Coalier, Noce; Gérard Mathieu, Cergy, both of France

[73] Assignee: The Mead Corporation, Dayton, Ohio

[21] Appl. No.: 632,472

[22] PCT Filed: Oct. 18, 1994

[86] PCT No.: PCT/FR94/01208

§ 371 Date: Jul. 18, 1996

§ 102(e) Date: Jul. 18, 1996

[87] PCT Pub. No.: WO95/11165

PCT Pub. Date: Apr. 27, 1995

[30] Foreign Application Priority Data

Oct. 19, 1993 [FR] France ..... 93 12450

[51] Int. Cl.[6] ..... B65D 5/465

[52] U.S. Cl. ..... 229/117.26; 229/117.24

[58] Field of Search ..... 229/117.09, 117.23, 229/117.24, 117.25, 117.26, 120.1, 931

[56] References Cited

U.S. PATENT DOCUMENTS

| | | | |
|---|---|---|---|
| 1,093,705 | 4/1914 | Labombarde | 229/177.25 |
| 2,290,971 | 7/1942 | King | 229/117.25 X |
| 2,654,475 | 10/1953 | Carpenter | 229/117.25 X |
| 2,682,990 | 7/1954 | Crary | 229/117.26 |
| 3,065,845 | 11/1962 | Nichols | 229/117.26 X |
| 3,276,663 | 10/1966 | Falconer | 229/117.24 |
| 4,498,420 | 2/1985 | Botterman et al. | 229/120.01 X |
| 5,145,108 | 9/1992 | Pinckney et al. | 229/117.26 |

FOREIGN PATENT DOCUMENTS

| | | | |
|---|---|---|---|
| 0 334 707 | 9/1989 | European Pat. Off. . | |
| 0 557 172 | 8/1993 | European Pat. Off. . | |
| 1496199 | 9/1967 | France | 229/117.26 |
| 1512737 | 2/1968 | France . | |
| 2 483 885 | 12/1981 | France . | |
| 2 206 564 | 1/1989 | United Kingdom . | |

*Primary Examiner*—Allan N. Shoap
*Assistant Examiner*—Christopher J. McDonald
*Attorney, Agent, or Firm*—Thomas A. Boshinski

[57] ABSTRACT

A carton has a bottom, side walls and top. A strap handle is attached to both sidewalls and extends over the top. The handle fits into slots that extend from the side wall into the top. The handles are attached to the side wall below these slots. The ends of the slots have enlarged areas that retain the handle as it extends through the slot. The enlarged areas can be any number of different shapes.

29 Claims, 12 Drawing Sheets

CARTON OR CARTON COVER OF RIGID SHEET MATERIAL WITH HANDLE

The present invention relates to a carton or a carton cover of sheet material such as flat board, corrugated board or an equivalent, relatively rigid material, including lateral faces and an upper face.

It also relates to a blank for making up such a carton or such a cover, and a method of manufacturing such a carton or such a cover with handle.

It finds a particularly important though non-exclusive application in the field of parallelepipedal cartons or ones more generally of polygonal horizontal cross-section, made from double-faced corrugated board and intended to contain fairly heavy products possibly ranging to several kilograzes, such as bottles of water for example, and including an upper face perpendicular to the lateral faces of the carton, therefore forming a cover at right angles to these faces.

Handle systems for transporting parallelepipedal cartons are already known. In general they involve lateral orifices cut out for example two thirds of the way up the carton in two opposing lateral faces. The user then grips the carton with the whole hand through the said orifices in order to carry it.

Such a system has drawbacks. In fact it requires an internal reinforcing band glued above the orifices in order to prevent the ripping of the material, this being expensive and complicated to implement.

Moreover the user must carry the carton with two hands, this being impractical.

Systems are also known having attached handles made for example from plastic or metal which are hooked onto a cord, a twine or a band which then completely surrounds the carton.

This system is however complicated to implement and prevents the palletizing of the cartons. The latter can in fact no longer be overlaid given the projections exhibited by the handles and/or twines surrounding the cartons.

The present invention aims to provide a carton or a carton cover, blanks and a process for manufacturing a carton or a carton cover with handle which is a better answer than those previously known to the practical demands in particular in that it proposes a simple, strong, inexpensive handle favouring the palletizing of the cartons and allowing the transporting by a user of a carton possibly containing a relatively heavy and bulky product, with a single hand.

For this purpose, the invention essentially proposes a carton, or a cover, of sheet material including lateral faces and an upper face, characterized in that the said carton or the said cover includes at least two frangible or slotted regions situated respectively either side of the carton or of the cover straddling the join lines between the upper face and two opposing lateral faces, the said regions each extending either side of the said join lines on the one side in the upper face and on the other side in the said corresponding opposing lateral face, over determined distances and in that it includes an attached elongate handle fixed on each side to the said opposing lateral faces, beneath the regions with respect to the upper face, the handle extending opposite the regions and opposite the portion of the upper face situated between the said regions, so that, when the handle is pulled substantially perpendicularly to the upper face, the handle sinks into the said regions.

Advantageously, the upper face forms an angle with the lateral faces at the level of the join lines between the said upper face and the said lateral faces, for example a right angle.

In advantageous embodiments, one and/or other of the following provisions is resorted the elongate handle is a flexible band;

the fixing of the handle to the lateral faces is done by glueing;

the length of the elongate handle between its points of fixing to the lateral faces, is equal or substantially equal to the sum of the distances between on the one hand the said points of fixing and the join lines of the corresponding lateral faces and on the other hand the width of the carton between the said join lines, so that the elongate handle can move between a first position, when flat, in which it hugs the outline of the carton and a second position, for grasping, partly distanced from the cover, in which it is sunk into the said regions;

the upper face is perpendicular to the lateral faces;

the regions are slots forming notches;

the regions are identical;

the developed shape, that is to say when flat, of the region in the direction perpendicular to the join line, is rectangular;

the developed shape of the region in the direction perpendicular to the join line, includes a central part able to form a central slit straddling, and perpendicular to, the join line, the said central part terminating on either side in widened parts which are symmetrical with respect to the said join line;

the central slit is triangular, with vertex pointing towards the upper face;

the central slit exhibits two concave sides with radius of curvature pointing outwards from the slit;

the central slit is rectangular;

the widened parts are transverse slits perpendicular to the central slit;

the widened parts are shaped substantially as an isosceles trapezoid whose large base points outwards from the region;

the developed shape of the region in the direction perpendicular to the join line, comprises a widened central part separated by narrow regions with the two likewise widened end parts;

the end border of the regions on the side of the upper face is rounded with an outwards pointing convexity that is to say, having a radius of curvature directed towards the interior of the region in question;

the determined distance b between the lower end border of the region and the join line between the upper face and corresponding lateral face, and the distance a between the upper end border of the region and the said join line are linked by the following relation:

$$\tfrac{1}{4} \leq a \leq 4b$$

the carton is of polygonal horizontal cross-section;

is characterized in that:

the lateral faces are connected together by way of first mutually parallel fold lines, and the upper face consists of inner flaps and outer flaps, the said flaps being connected respectively to the said lateral faces by second fold lanes orthogonal to the said first fold lines, each inner flap being secured to a lateral face which lies between two lateral faces respectively furnished with outer flaps;

the frangible or slotted regions are situated in the prolongation of the join line or space between opposing flaps whose opposite borders are the opposing borders closest to the upper face;

the frangible or slotted regions extend parallel to the opposite borders of the flaps furthest from the upper face;

the carton exhibits a widened central slit between peripheral borders facing the flaps, square with and parallel to the handle, allowing easier grasping of the said handle by a user;

the regions are laid out so as to allow the elongate handle to bear on the products arranged inside the carton.

The invention also proposes a blank of corrugated board or similar sheet material for making a cover or a carton, the said blank including:

a string of rectangular panels connected together by first parallel fold lines; and a first assembly of lateral flaps arranged on one side of the said string of panels, connected to this string by second fold lines perpendicular to the said first fold lines and intended to form the upper face of the said carton or of the said cover, the said first assembly of lateral flaps including inner flaps for forming the inner part of the said upper face and outer flaps for forming the outer part of the said upper face;

characterized in that it includes at least two frangible or slotted regions respectively straddling and centred laterally on the second fold lines of two non-adjacent flaps termed first flaps, intended to form two opposing flaps of the upper face of the carton or the cover, the said regions each extending either side of the said second corresponding fold line over determined distances.

In advantageous embodiments, one and/or other of the following provisions is moreover resorted to:

the first flaps are the inner flaps;

the first assembly of flaps comprising four flaps, the other two flaps of the said first assembly termed second flaps, include facing peripheral borders exhibiting at their end slots or frangible parts able to be superimposed with the said regions of the first two flaps.

The invention also proposes a blank comprising a series of panels separated in pairs by first fold lines and able to at least partly envelop the product to be packed in order to form the upper face and two lateral faces of a carton or of a cover, the said panels being furnished on either side with lateral flaps intended to form two other lateral faces of the carton or of the cover, characterized in that it includes at least two frangible or slotted regions one the prolongation of the other, respectively straddling two first fold lines situated between three consecutive panels.

In an advantageous embodiment, one of the end panels of the series is a glueing tab, one of the frangible or slotted regions straddles the first fold line situated between the said tab and the adjacent panel, and the other end panel includes a complementary, frangible or slotted region facing, once the carton is formed, the said region of the tab.

Advantageously, the regions exhibit shapes and dimensions of the type of those described with reference to the above cartons.

Also advantageously, the invention proposes an assembly comprising a blank of the above type furnished with an attached flat band fixed to its ends respectively on two of the panels, either side of the two regions, and extending opposite the regions and opposite the panel situated between the said regions parallel to and substantially in contact with, that is to say hugging the surface of the said panel.

The invention also proposes a process for manufacturing cartons or covers such as described above.

Advantageously, the invention proposes a process for manufacturing a carton or a carton cover with handle of the type described above, in which is formed the carton in which the product to be packaged is placed, the said process being characterized in that a first end of the handle is glued underneath a first region, the handle is unwound while applying it to the lateral faces, and the upper face, opposite the said regions, and the other end of the handle is glued underneath the other facing region, so that the elongate handle can move between a first position, when flat, in which it hugs the outline of the carton, and a second position, for grasping, partly distanced from the cover, in which it is sunk into the said regions.

In advantageous embodiments, the invention also proposes a process in which:

the walls and the bottom of the carton are formed, the carton subsequently being filled with the products to be packaged, and the previously glued-on flaps are folded over the products in order to form the cover;

the carton being designed in order to exhibit a widened central slit between facing peripheral borders of the outer flaps of the cover, which are parallel to the handle;

the inner cover flaps (7) corresponding to the regions are firstly folded over, and then the handle is glued and applied to the said flaps, and the outer flaps (9') are next folded over;

the handle is previously set in place and glued on the blank when flat, before forming the said carton from the said blank.

The invention will be better understood on reading the description which follows of particular embodiments given by way of non-limiting example.

The description refers to the drawings which accompany it and in which.

Figure 11:
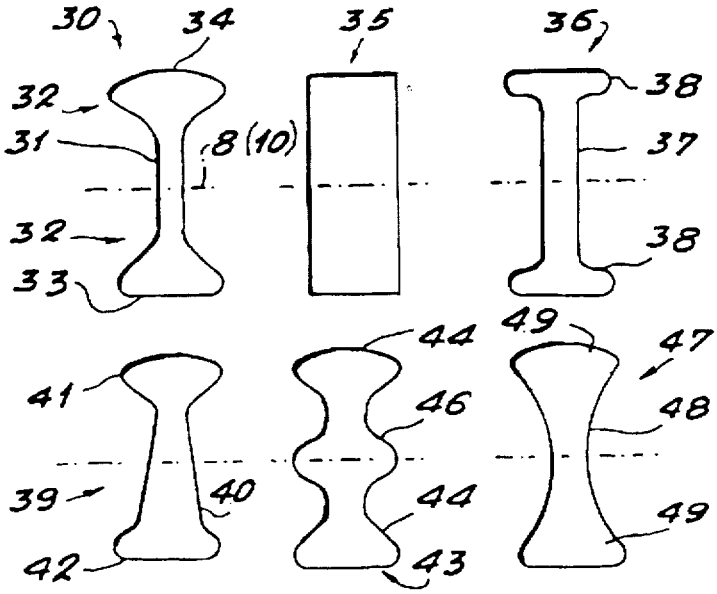

FIG. 11 gives various embodiments of regions according to the invention.

Figure 12:
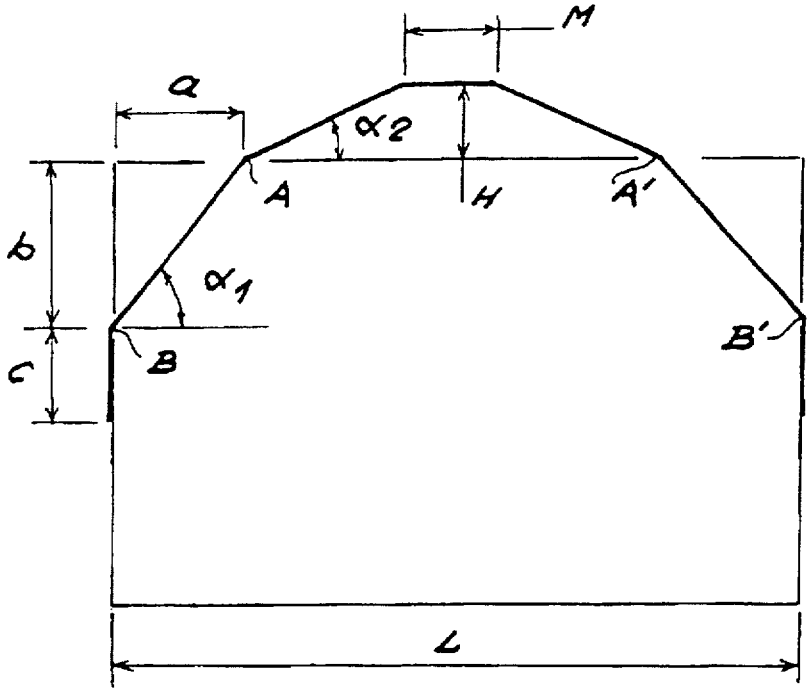
Figure 13:
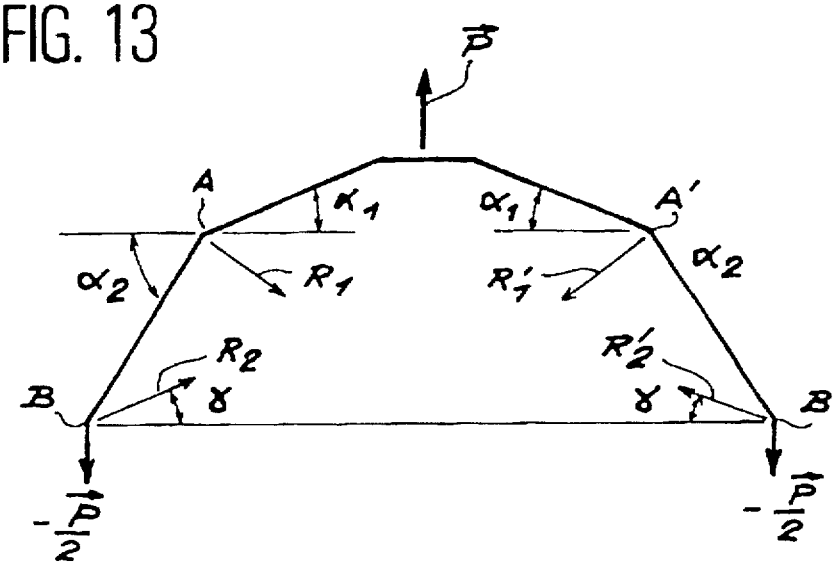

FIGS. 12 and 13 are diagrams showing the shape of a handle in section, after tensioning, according to the embodiment of the invention more particularly described here, as well as the distribution of the loads.

Figure 14:
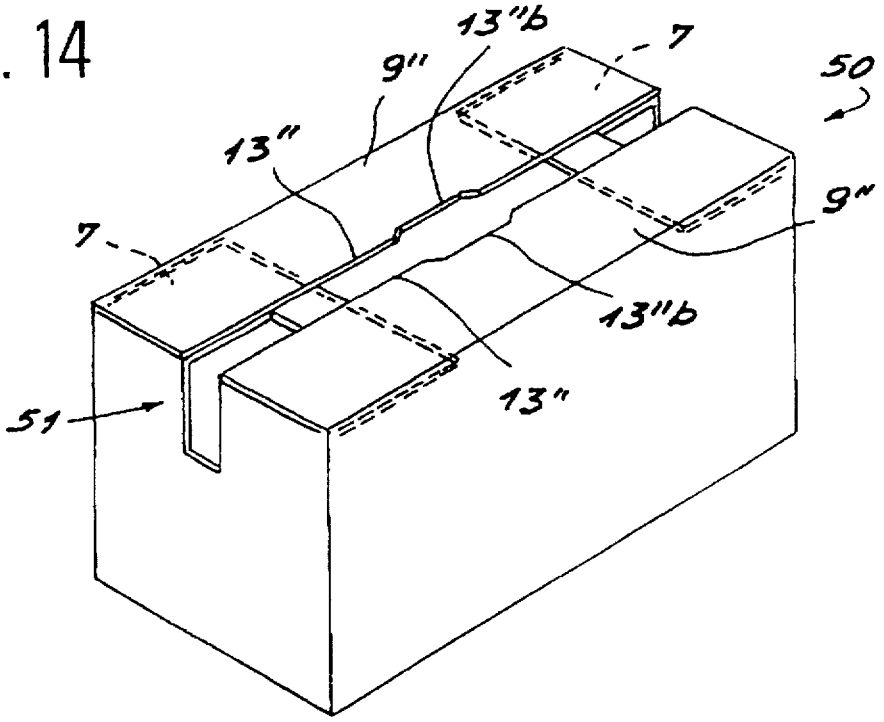
Figure 15:
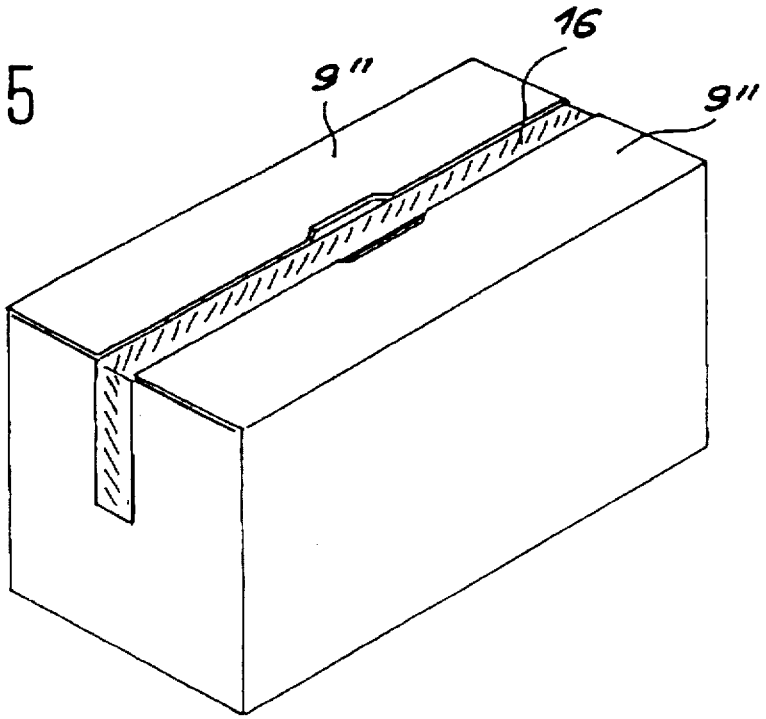

FIGS. 14 and 15 show in perspective another embodiment of a carton according to the invention, before and after installing a band-shaped handle.

FIGS. 16 to 23 show various embodiments of blanks according to the invention.

Figure 24:
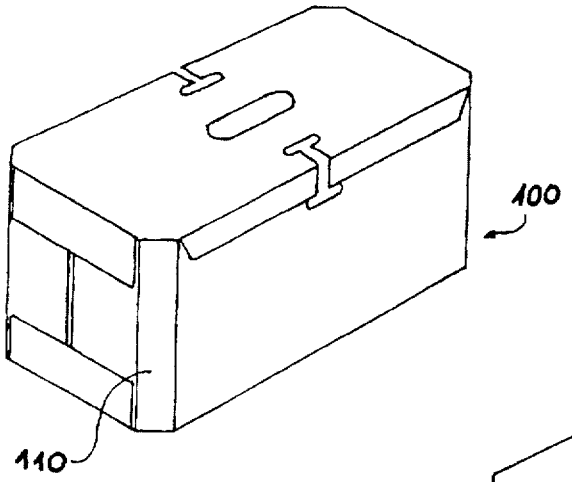
Figure 25:
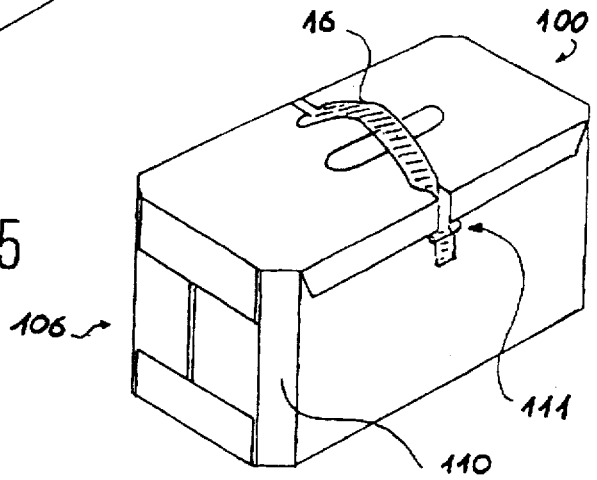

FIGS. 24 and 25 show, in perspective, a carton according to another embodiment of the invention, before and after installing the handle.

Figure 26:
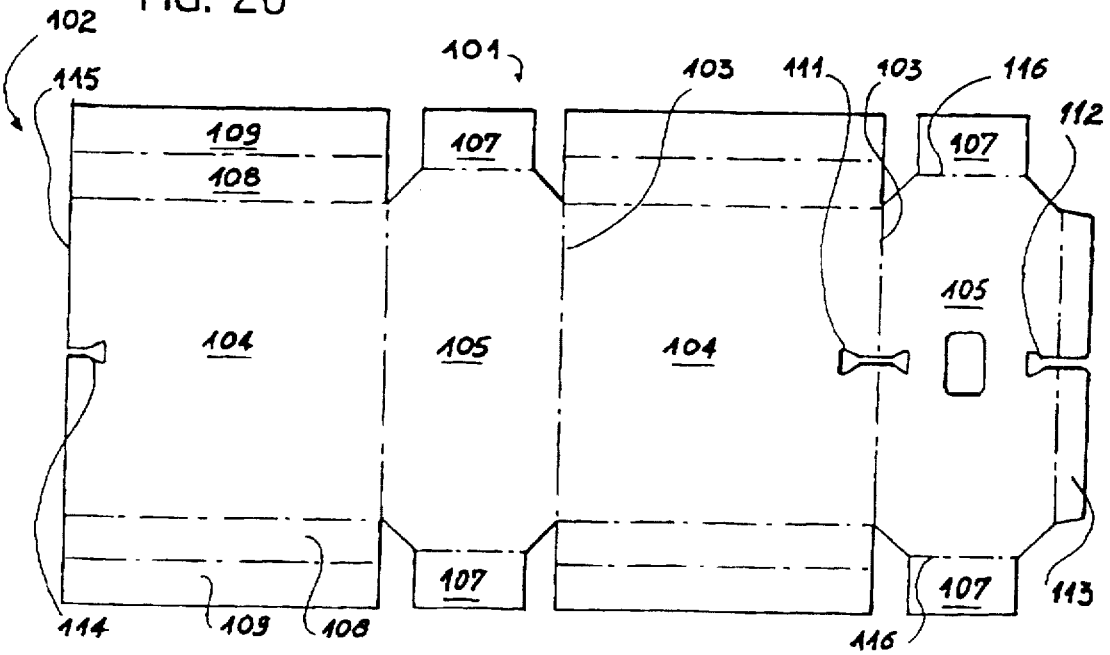

FIG. 26 shows another embodiment of a blank according to the invention.

Figure 27:
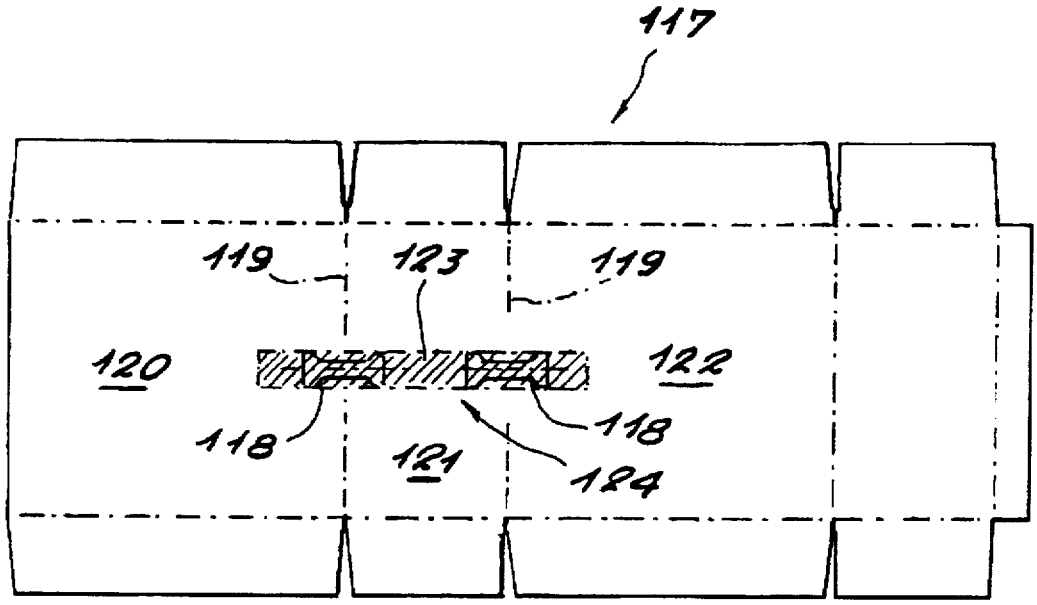
Figure 28:
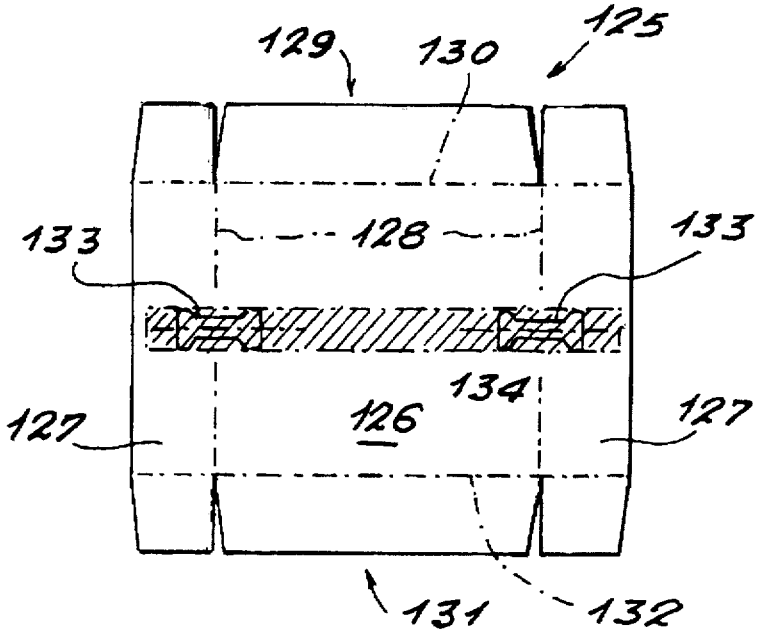

FIGS. 27 and 28 show "blank plus handle" assemblies, made up directly when flat, according to a particularly advantageous embodiment of the invention.

Figure 29:
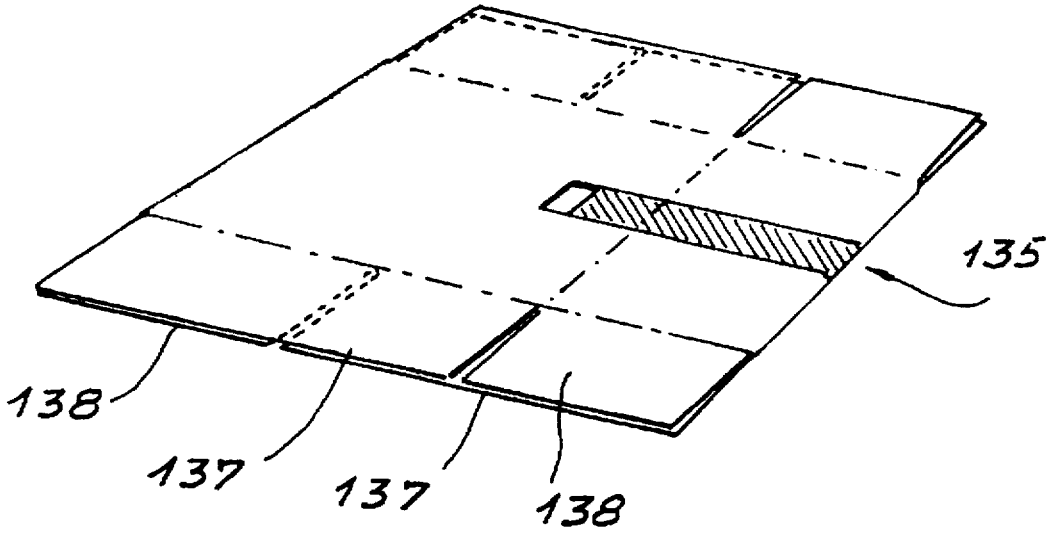

FIG. 29 shows a pre-folded blank for forming an American carton, such as conventionally delivered, furnished with a handle according to the invention.

Figure 30:
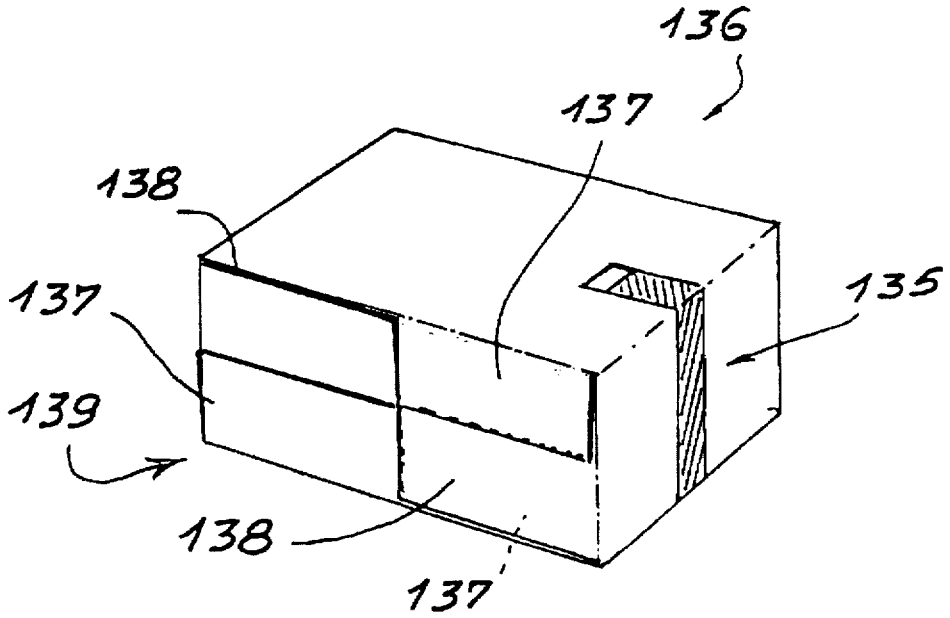

FIG. 30 shows the American carton formed from the blank of FIG. 29.

Figure 1:
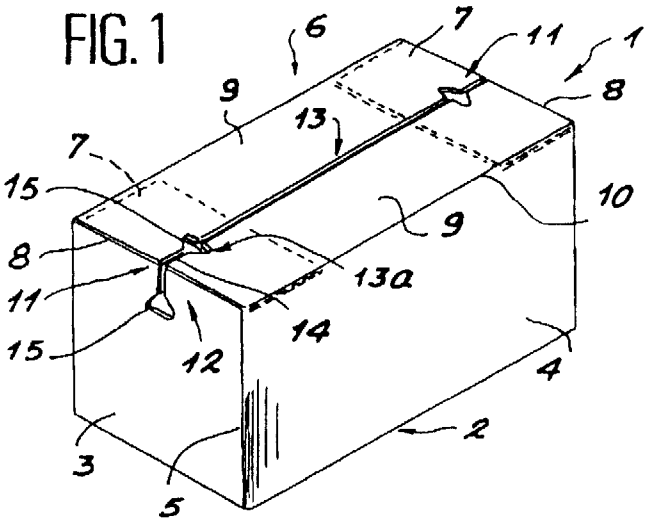
FIG. 1 is a perspective view showing a first embodiment of a carton according to the invention before installing a handle.

FIG. 1 shows a parallelepipedal carton 1 made from double-faced corrugated board, for example 5 mm thick, for bottles of water, including a bottom 2, four lateral faces, namely two small faces 3 and two large faces 4, separated from one another by first fold lines 5, and an upper face 6, composed of two small inner flaps 7 (shown by broken lines in FIG. 1) connected respectively to the small lateral faces 3 by second fold lines 8, and of two large outer flaps 9 connected respectively to the large lateral faces 4 by second fold lines 10.

The carton includes two regions 11 in the form of slots which are identical, for reasons of symmetry, and which correspond to the second fold lines 8, straddling the said lines and extending either side in the lateral face and the cover.

In the embodiment of FIG. 1, the two large flaps are substantially mutually adjoining at the level of their outer peripheral border 13, in the closed position, the slots therefore being formed on the one hand by a cutout 12 in the lateral faces 3 and the inner flaps 7, and on the other hand by symmetrical notches 13*a* made on either side on the ends of the peripheral borders 13 of the large flaps 9, the said notches being able to be overlaid on each side over the contour of the portion of cutout 12 made in the inner flaps 7.

The slots 11 are thus formed opening directly onto the inside of the carton 1.

More precisely, the slots 11 here comprise a central, rectangular slit 14, for example 5 mm thick and 5 cm long, straddling the lines 8 and two end parts 15 shaped substantially as isosceles trapezoids whose large base is on the outside of the slot, the said end parts being for example arranged symmetrically with respect to the fold line 8.

The carton 1 (see FIG. 2) includes an elongate flexible handle 16 in the form of an inextensible flexible band of strong paper for example manufactured by the American company 3M.

This band advantageously includes a central preferential fold region, for example formed by a longitudinal central prefold facilitating sinkage into the slots. It is for example of a width equal to or slightly less than the width of the large base of the end parts 15, and greater than or slightly greater than the width of the slit 14, this facilitating its application to the outline of the carton before tensioning.

The handle 16 is fixed at 17, underneath the regions 11 with respect to the upper face by glueing, over a determined distance c which will be adjusted as a function of the quality of the adhesive and of the weight of the carton, for example over 2 cm to 8 cm.

It is arranged facing the slots 11 in a first position, when flat, in which it hugs the outline of the upper part 8 of the carton, above the points or regions of fixing 17.

The small width of the central slit 14 therefore allows an arrangement with the band bearing on the outline of the carton in this embodiment of the invention.

Figure 3:
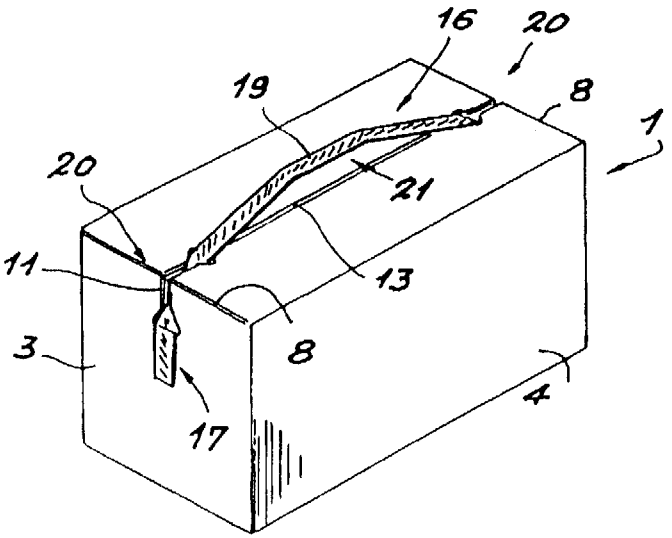
FIG. 3 shows the carton of FIG. 2 after tensioning the handle.

FIG. 3 shows the same carton, after vertical or substantially vertical tensioning, at 19, of the handle 16.

The latter sinks at 20 at the level of the fold lines 8, into the slots 11, this freeing a space 21 which will allow the grasping by a user of the handle which is thus partly distanced from the cover.

The glueing of the handle at its ends to the paper board carton is sufficient to support the weight of the carton.

By contrast, when the user wishes to open the carton it is sufficient for him to tear the points (or areas of glueing) 17 by pulling perpendicularly with respect to the lateral walls 3.

In what follows the same reference numbers will be used to designate the same elements.

Figure 4:
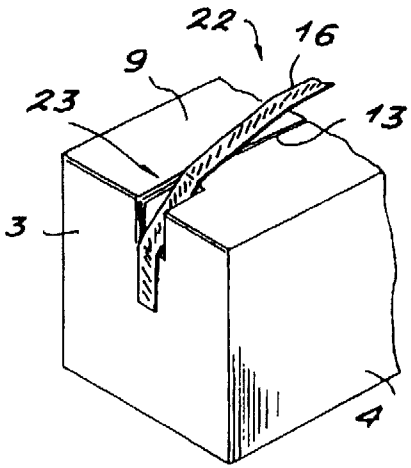
FIG. 4 is a perspective view showing another embodiment of the region according to the invention, here in the form of a rectangular notch.

FIG. 4 shows another embodiment of a carton 22 comprising a slot 23 in the prolongation of the join line 13 between opposing large flaps 9. The slot is here of rectangular shape with width identical to or slightly greater than that of the band 16.

Figure 6:
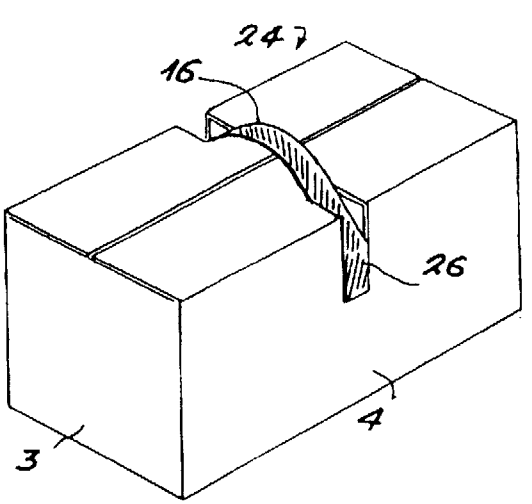
FIGS. 5 and 6 are perspective views showing another embodiment of a carton according to the invention, in the case where the handle is installed on the lateral faces corresponding to the large flaps, before installing the handle (FIG. 5) and after installing the handle and tensioning the latter (FIG. 6).
Figure 5:
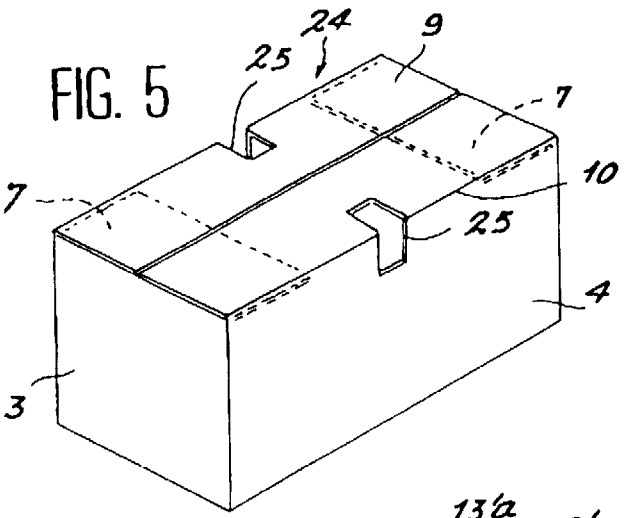
Figure 7:
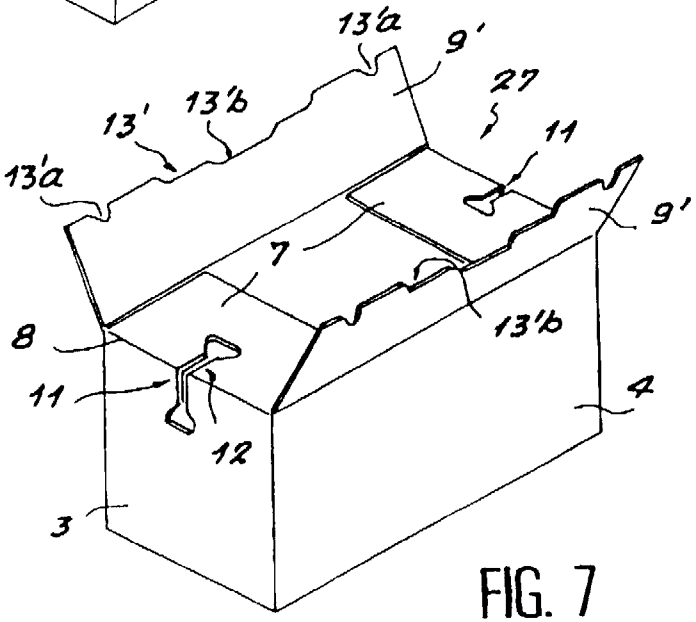

FIGS. 5 and 6 show another embodiment of a carton 24 according to the invention in which the two slots 25 are situated on the fold lines 10 of the large flaps 9.

In this case, it is not necessary to modify the other two flaps, in this instance the small flaps 7.

The handle 16 is then arranged as shown in FIG. 6, the ends of the band being fixed at 26 to the face 4, beneath the slots 25.

FIGS. 7 to 10 show another carton embodiment 27 according to the invention.

The carton comprises two slots 11 of the type of those described with reference to FIGS. 1 to 3 including two cutouts 12, on the fold lines 8 corresponding to the small lateral faces 3 and to the small flaps 7.

The two large flaps 9' themselves comprise an external peripheral border 13' furnished with symmetrical notches 13'*a* made either side on the ends of the border 13' and able to be overlaid on the contour of the portion of cutout 12 in the inner flaps 7, on each side.

The borders 13' moreover comprise a central, notched part 13'*b*, with contours which are symmetrical with respect to the mid-line perpendicular to the fold lines 10 of the carton, exhibiting a first ledge parallel to the line 13' at a first distance therefrom and a second ledge parallel to the line 13' at a second distance therefrom, the said distance being greater than half the width of the band 16.

Figure 2:
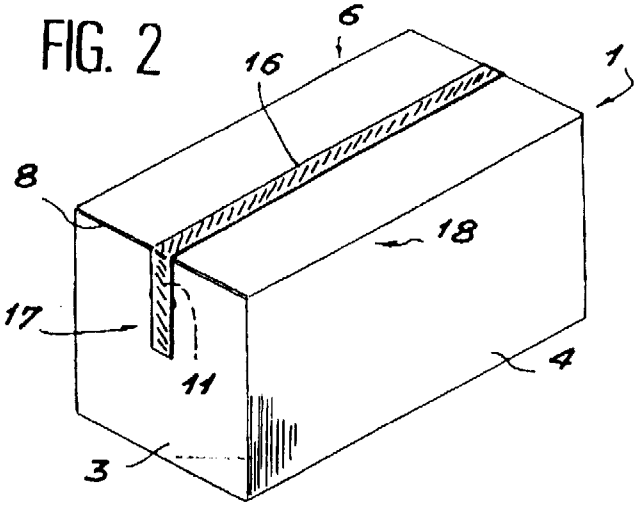
FIG. 2 is a view of the same carton after installing a flexible handle in the form of a band glued to the opposing lateral faces and before a tension is exerted on the said handle.

The latter (see FIG. 8) is glued at 17, as indicated with reference to FIG. 2, and stretched directly over the internal flaps 7.

Figure 9:
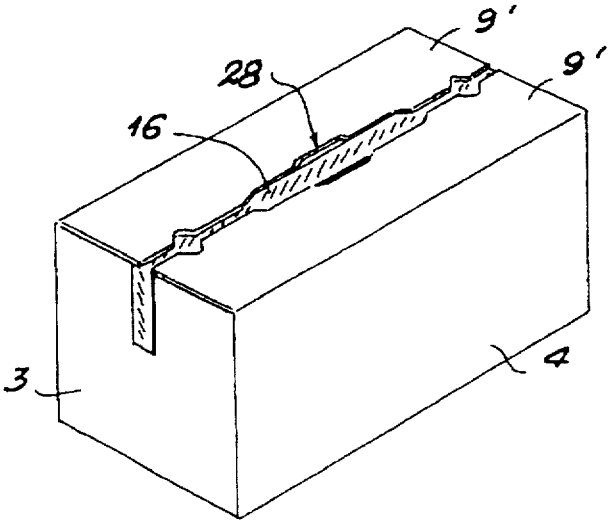
Figure 10:
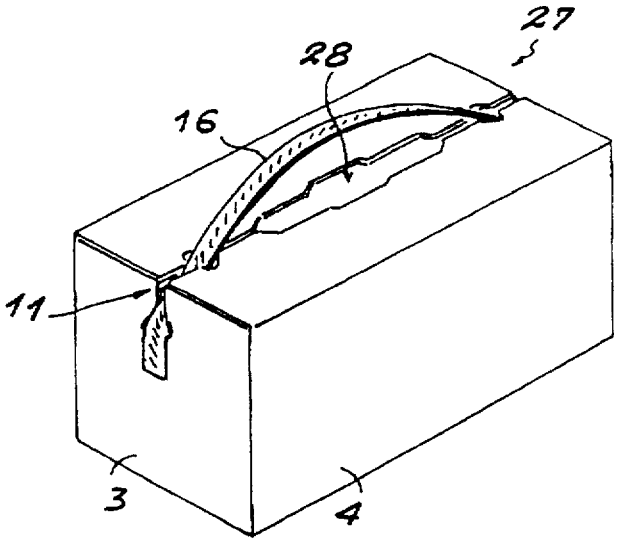

The flaps 9' are next turned down over the band 16 (see FIG. 9) leaving s central space 28 of greater width than the band 16 and allowing a user to thus easily grip the handle, as shown in FIG. 10.

FIG. 11 shows, non limitingly, six different embodiments of the regions according to the invention, which can be slots, or fragible regions, or a superposition of slots in the flaps for example and of frangible regions in the walls or vice versa.

In FIG. 11, the fold lines 8 or 10 are portrayed chain dotted.

The shape of the region 30 is of the type of that described with reference to the preceding figures.

It includes a rectangular central slit 31 extending either side of the fold line and furnished with two end parts 32 which are symmetrical with respect to the line 8 or 10. The two parts exhibit a trapezoidal or triangular shape, the large bases 33 and 34 of which are situated towards the outside of the region.

Advantageously the base 34, on the cover side, is of rounded shape so as to improve the holding of the band on the said base 34, of width substantially equal to, slightly larger than or slightly smaller than that of the band 16.

The region 35 is itself rectangular, for example of slightly greater width than that of the band 16 designed to sink therein.

The region 36 is similar to the region 30. It possesses a slit-shaped central part 37 and two end parts 38 which are perpendicular and symmetrical with respect to the fold line, for example of width equal to or less than the central slit.

The region 39 exhibits a lock shape, with a substantially triangular or frustoconical central slit 40 with vertex pointing towards the cover.

It includes two widened end parts, one trapezoidal or inverted triangular (41) pointing towards the cover, and the other (42) in the shape of a rectangular slit parallel to the fold line.

The region represented at 43 exhibits two end parts 44 similar to the parts 32 of the region 30 and a widened central portion 45, for example oval.

The region 46 itself exhibits a slit 47, whose walls 48 are curved with an outwards pointing radius of curvature and terminate on either side in two substantially identical widened end parts 49 of width greater than or equal to that of the handle band 16.

FIG. 12 gives diagrammatically the distances existing between various bearing points of a carton according to the invention, making it possible in particular to adapt the dimensions of the regions as a function of the products contained in the carton, especially when desiring to make the ends of the regions, for example 33 and 34, when referring to the slit 30 of FIG. 11, coincide with the locations of the products on which it is wished to bear.

The distance a being fixed (for example owing to the location of the stopper of a bottle with which it is wished to make the line 34 of the region coincide) and b being or not being conditioned by a bearing on the wall of the said bottle, we have the relations $b = a\tan\alpha_1$ with $$\alpha_1 = \text{Arcos}\left[\frac{2K}{K^2+1}\right]$$

for $$K = \frac{\frac{L}{2} - \frac{H}{\sin\alpha_2} - \frac{M}{2}}{a}$$

and $$\alpha_2 = \text{Artan}\left[\frac{H}{\frac{L-M}{2} - a}\right]$$

with L=width or length of the carton and M=width of the user's hand.

FIG. 13 makes it possible to set up a simplified model of the stresses on the board, which allow those skilled in the art to size a and b as a function of the weight of the products in the carton, the sheet material used and the customary parameters to be taken into account when ensuring sufficient solidity of the handle.

The friction of the band at A and A' will be neglected, the weight of the carton being assumed to be distributed at B and B'. The tension P is regarded as applied at the centre of the handle, and the deformation of the board or of the sheet at A and at B is neglected.

It follows that:

$$R_1 = \frac{-P}{2\sin\alpha_1} \times \frac{\cos\alpha_2 - \cos\alpha_1}{\sin\frac{\alpha_1 - \alpha_2}{2}}$$

$$\beta = \frac{-\pi}{2} + \left[\frac{\alpha_1 + \alpha_2}{2}\right]$$

$$R_2 = \frac{+P}{2} \times \frac{\cos\alpha_2}{\cos\alpha_1} \times \frac{1}{\cos\delta}$$

with $$\tan\delta = \frac{\sin\alpha_2 - s\cdot\alpha_1}{\cos\alpha_2} \quad \text{[sic]}$$

FIGS. 14 and 15 show another advantageous embodiment of a carton 50, with slot 51, a rectangular cutout in the small lateral faces 3 and in the small inner flaps 7. The borders 13" of the large outer flaps 9" are here a distance apart which is greater than the width of the band 16, for example equal to the width of the cutout 51.

In this case, a central notch **13"*b* in the peripheral border 13"** is advantageously provided so as to facilitate the seizure of the handle by a user.

Represented in FIGS. 16 to 23 are embodiments of blanks according to the invention.

FIGS. 16 to 19 (see more particularly FIG. 17) show blanks 60, 61, 62, 63 comprising four rectangular panels 64, namely two large panels 65 and two small panels 66 connected together by first parallel fold lines 67 and comprising a glueing tab 68 at the end of one of the four panels.

An assembly 69 (termed the second assembly) of lateral flaps connected to the string of panels by third fold lines 70 perpendicular to the first fold lines, is provided so as to form the bottom of the carton.

An assembly 71 (termed the first assembly) of lateral flaps arranged on the other side of the panels, namely two large flaps 72 associated with the two large panels and two small flaps 73 associated with the small panels, connected to the said panels by second fold lines, 74 and 75 respectively, is provided so as to form the upper face of the carton.

The slots 30 are themselves, for example, situated on the lines 75 between small panels and small flaps.

The small flaps are here substantially rectangular. The large flaps are themselves likewise substantially rectangular and separated from the small flaps by spacings 76, known per se to allow formation of the carton.

The large flaps comprise a peripheral lateral border 13 (FIG. 17) or 13' (FIG. 16) such as described above with reference to the cartons.

Figure 18:
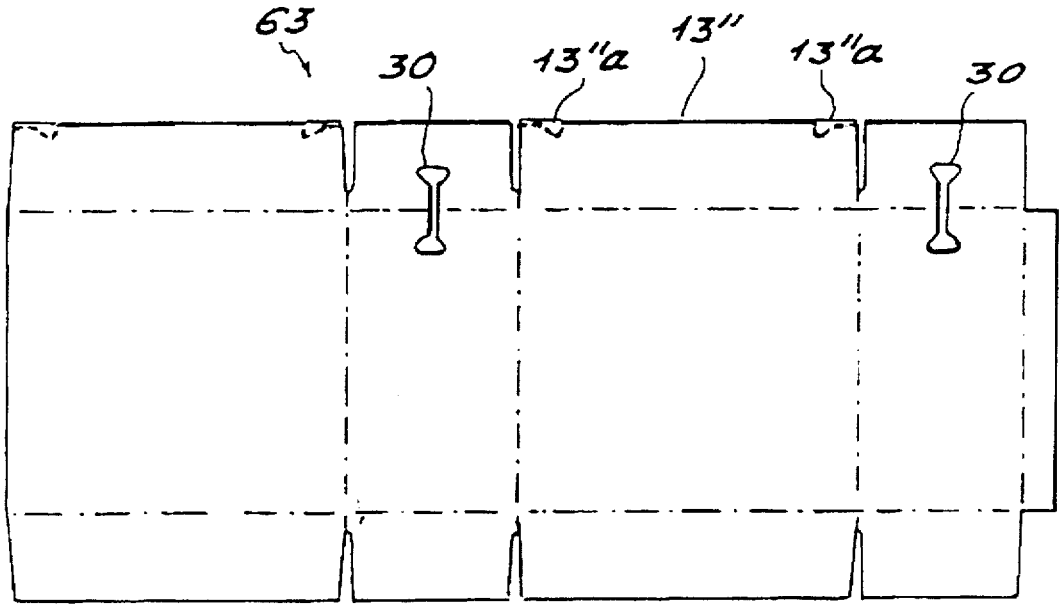

FIG. 18 itself shows a border 13" similar to the border 13 but in which, instead of being slotted, the end parts **13"*a*** are simply perforated so as to constitute frangible regions which can be torn out when the handle sinks into the formed carton.

Figure 19:
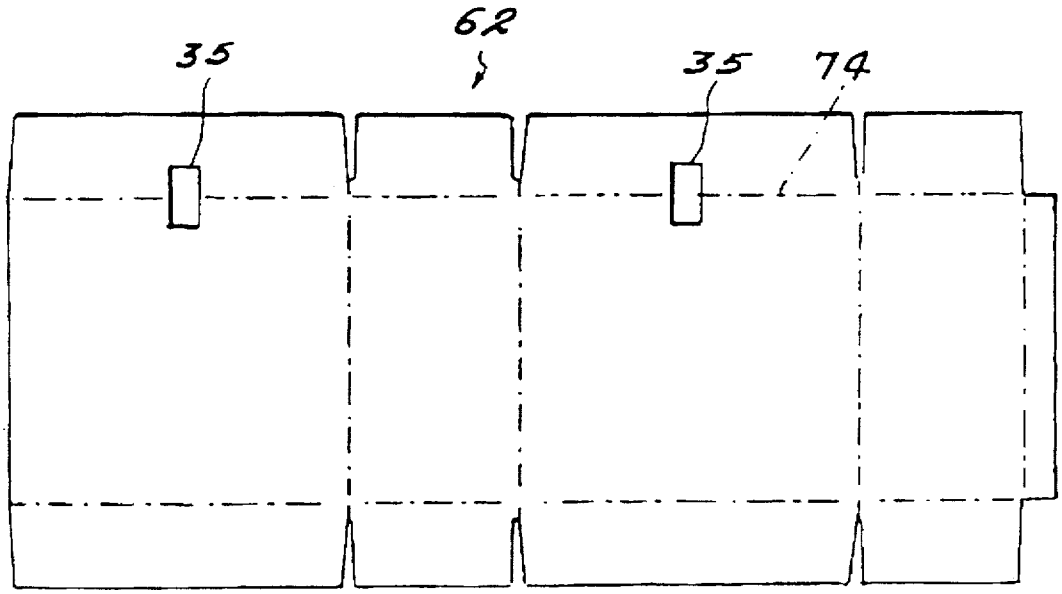
Figure 20:
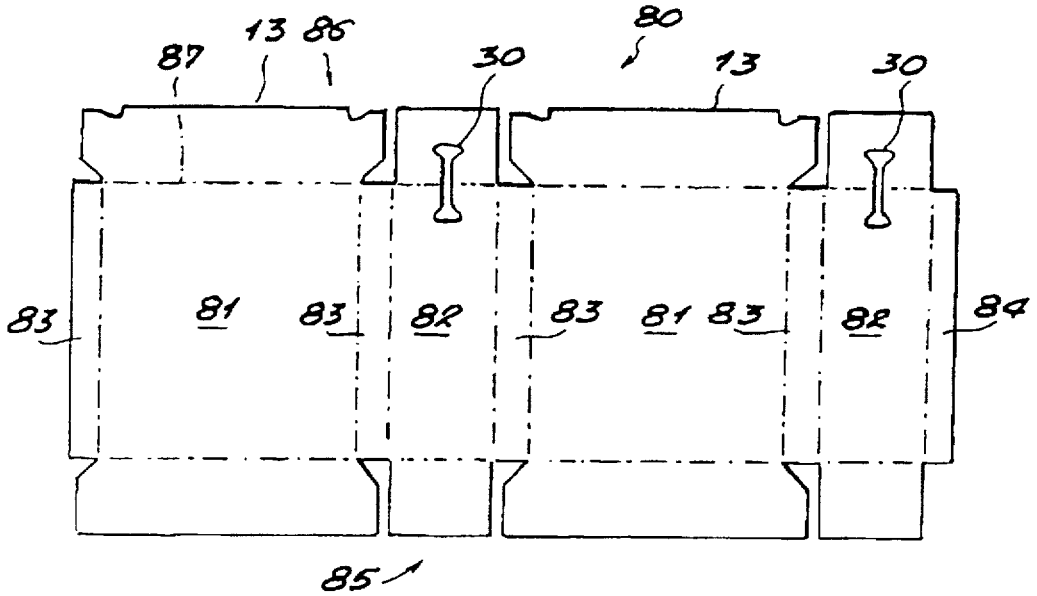

FIG. 19 shows another embodiment in which the slotted regions, here rectangular, are situated on the fold lines 74 of the large sides.

The peripheral external border of the other two flaps are [sic] here simply parallel to the third fold lines.

FIGS. 20 to 23 themselves show blanks 80 with eight panels, namely two large panels 81 and two small panels 82 and four cut zones 83, connected together by parallel fold lines and a glueing tab 84, in order to form cartons with cut corners.

The panels for forming the lateral faces are furnished with lower flaps 85 connected to the panel by fold lines so as to form the bottom of the carton, and upper flaps 86, to form the cover, likewise connected by fold lines 87 perpendicular to the inter-panel fold lines.

Two upper flaps, for example those corresponding to the large panels, are furnished with an end border slanting outwards from the fold lines, to form the octagonal cover.

The other two small flaps are themselves furnished with regions in accordance with the invention.

The peripheral border 13 of the large flaps is adapted accordingly, as described above, for example with reference to FIG. 17.

Figure 16:
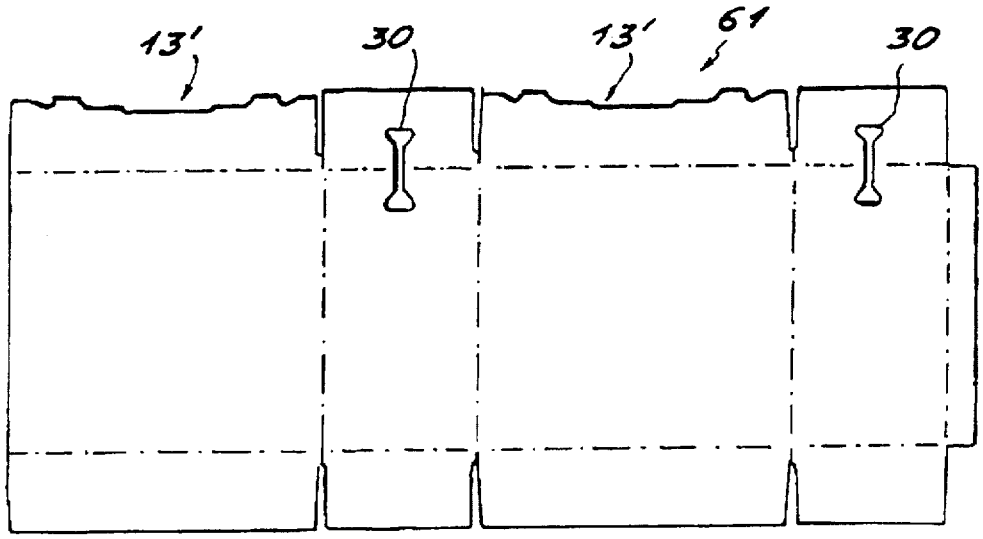
Figure 17:
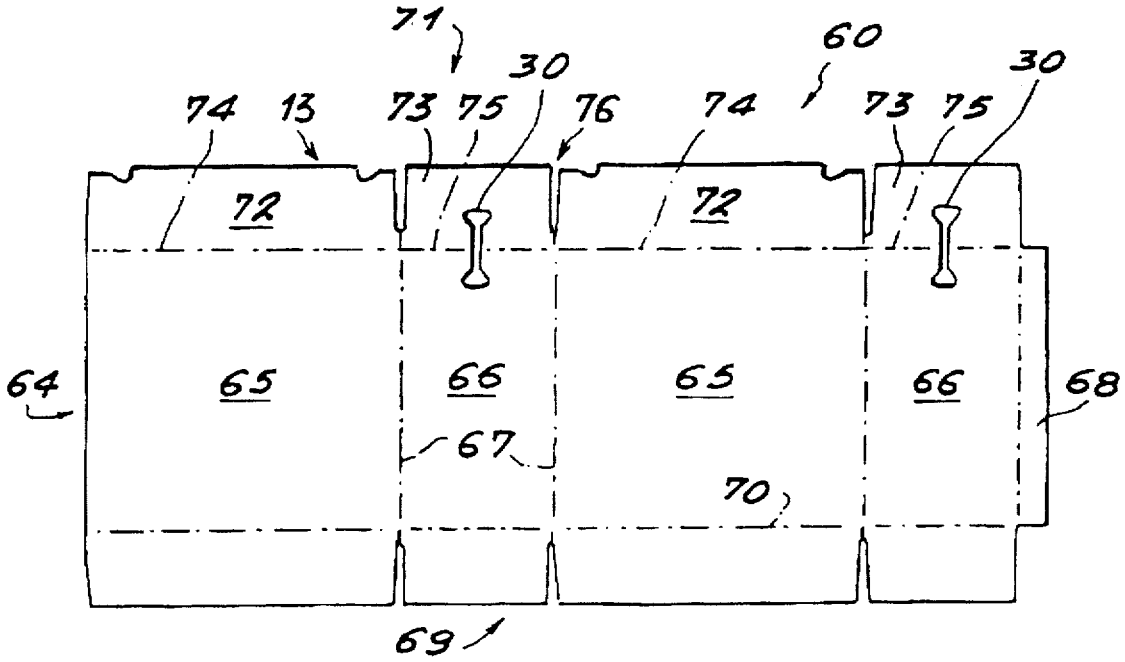
Figure 21:
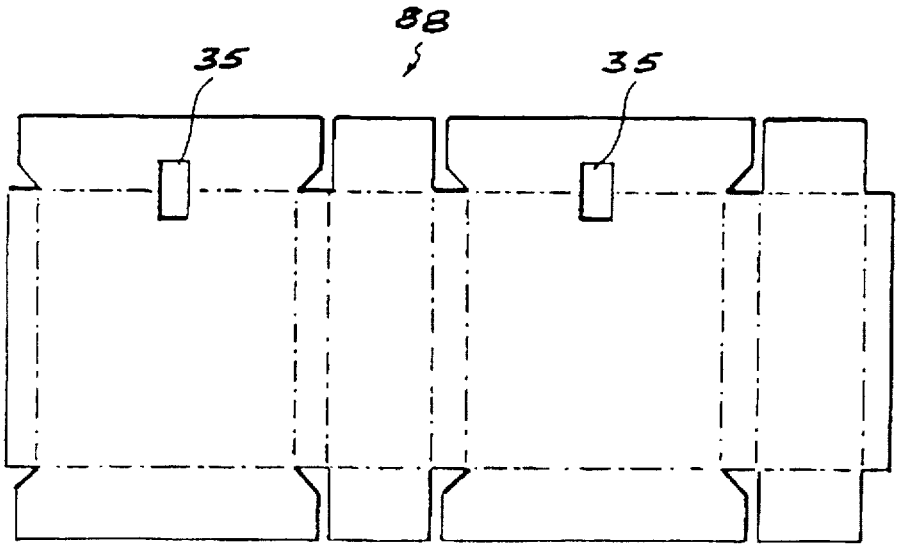
Figure 22:
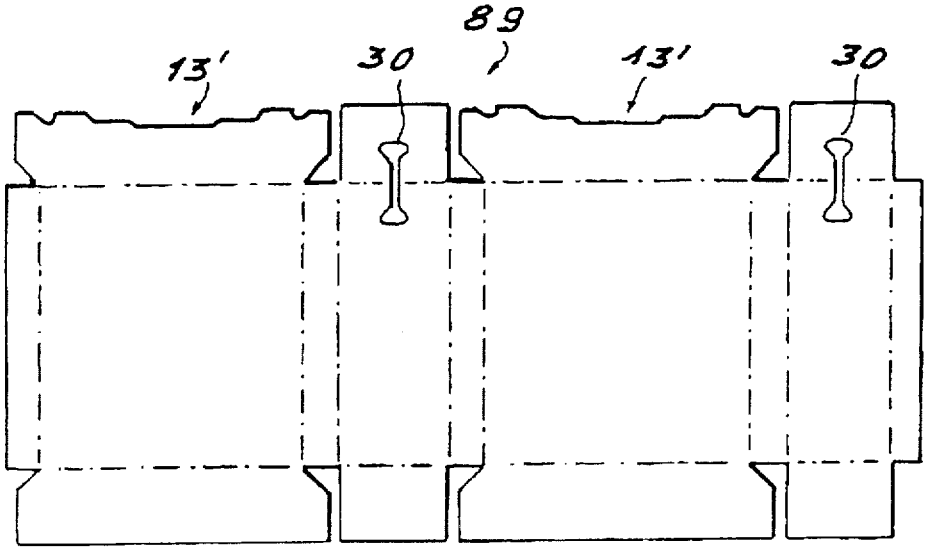
Figure 23:
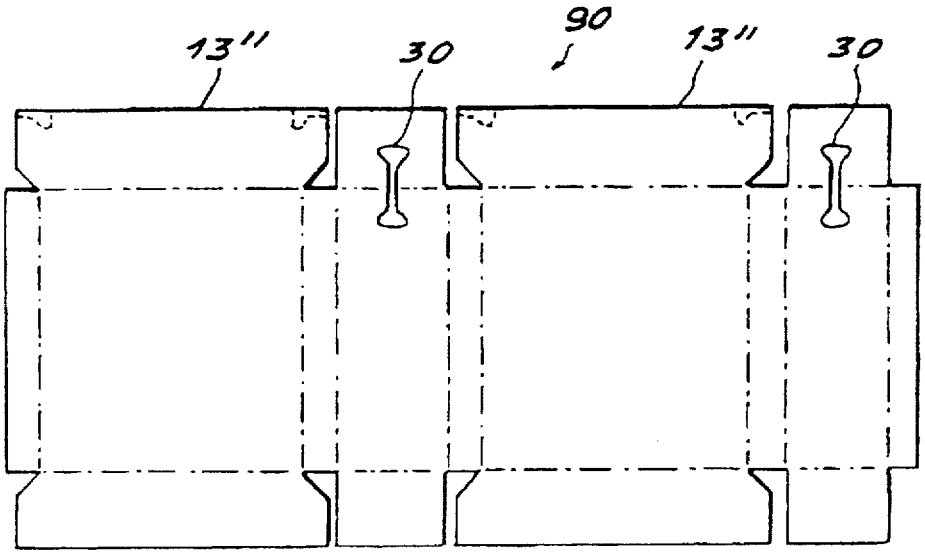

FIG. 21 shows a blank 88 comprising regions according to the invention on the join lines between large panels and large cover flaps, FIGS. 22 and 23 showing blanks 89 and 90 corresponding to FIGS. 16 and 18 in respect of four-panel blanks.

The manufacture of a carton will now be described according to one embodiment of the invention, while referring more particularly to FIGS. 7 to 10.

The carton 27 is formed in a manner known per se, for example around a fixed mandrel as described in the document EP 334.707, starting from the blank of FIG. 16.

Once the carton has been formed, it is ejected and then filled with the intended products. The panels 7 (see FIG. 7) are next closed up, the panels 9' being apart.

The band 16 is then fitted, by glueing a first end 17 to the corresponding panel 3 and then taughtening the said band so as to make it hug the shape of the carton up to the other end where it is likewise similarly glued, under light tension.

Figure 8:
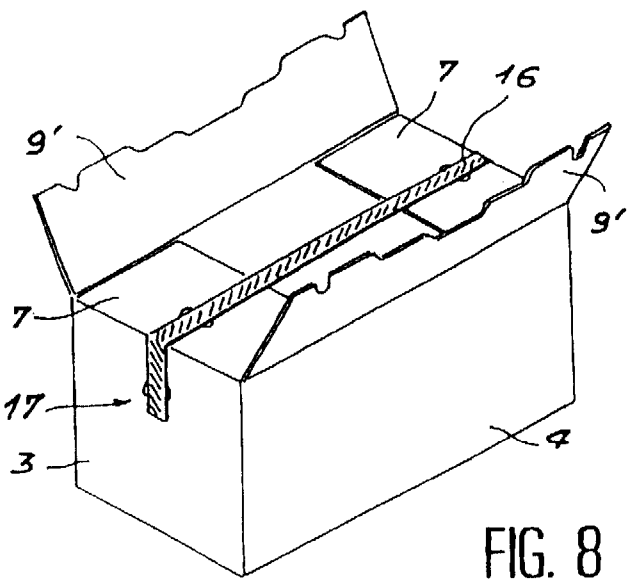
FIGS. 7 to 10 show perspective views of another embodiment according to the invention, in the case where the handle is installed over the small flaps and under the large flaps (FIGS. 7 and 8), before closing these latter (FIG. 9) and tensioning the handle (FIG. 10).

The band 16 is thus fully applied to the outside of the slots and hugs the upper outline of the carton as shown in FIG. 8.

Next, the previously glued panels 9' are turned down and pressed onto the internal panels 7 in order to effect the glueing.

The band 16 is therefore situated under the external panels 9', this permitting perfect palletization, no nuisance projection appearing (see FIG. 9).

When it is desired to take a grip on the carton, the band 16 is pulled at the middle, this causing the sinking of the band into the slots 11, or transverse cutouts, made in the edges of the carton, and thus allows single-handed transportation as described above.

FIGS. 24 and 25 show another embodiment of a carton 100 according to the invention, starting from a blank 101 of the type described with reference to FIG. 26.

The blank comprises four panels 102 connected together by parallel fold lines 103. There are for example two rectangular panels 104 able to form the two lateral walls of the carton and two octagonal panels 105 able to form the top and bottom of the carton.

The panels 105 comprise, on either side, rectangular flaps 107 in order to form the external part of the lateral faces 106.

The panels 104 themselves comprise two adjoining parallel successive flaps 108 and 109 able to form the cut comers 110 of the carton and the external parts of the lateral end faces 106.

The blank moreover comprises regions of the type of those described above, namely and for example a slotted region 111, straddling and centred on the fold line 103 between the panel 104 and the panel 105 able to form the upper face of the carton, a region 112 on the fold line between the said panel 105 and an end tab 113, for glueing, and a complementary slot 114 on the external border 115 parallel to the lines 103 of the opposing end panel.

The superpositioning of the slots 112 and 114 coincides with the slot 111 when the blank is folded up to form the carton around the product.

Of course, the regions according to the invention can also be arranged on the fold lines 116 between octagonal panel 105 and flaps.

The process for forming the carton represented in FIGS. 27 and 28 is performed by the technique known as WRAP which consists in forming the carton around the product as described for example in the document EP-A-557-172.

The forming of the carton is next completed by glueing the handle, proceeding as follows:

a first end of the handle is glued underneath a first region 111, the handle is unwound while applying it to the faces, and the upper face, opposite the said regions, and the other end of the handle is glued underneath the other facing region, so that the elongate handle can move between a first position, when flat, in which it hugs the outline of the carton, and a second position, for grasping, partly distanced from the cover, in which it is sunk into the said regions.

FIG. 27 shows a blank 117, in the developed position (laid flat), of the type described with reference to FIG. 19. The frangible or slotted regions 118, for example of the slots 30 type (see FIG. 11), are here situated straddling, and in the middle of, the first fold lines 119 of separation between three consecutive panels 120, 121 and 122, namely two large panels 120 and 122 and a small panel 121 interposed between the two.

A band 123 of strong material and small thickness is fixed by its ends to the blank when flat, to the panels 120 and 122 respectively, on either side of the regions 118, so as to extend in contact with and opposite the regions and the central part 124 of the panel 121, which part is situated between the said regions 118.

The fixing of the band is easily operated automatically at high speed, by cutting out and applying the band to the blanks. This is one of the advantages of the invention.

FIG. 28 itself shows a blank 125 for cover including three panels, namely a central panel 126 forming the upper face of the cover, and two lateral panels 127, for forming two opposing lateral borders of the cover, the said panels being connected together in pairs by first parallel fold lines 128. The blank moreover includes two series of rectangular or substantially rectangular flaps, namely a first series 129 connected to one side of the panels by second fold lines 130 perpendicular to the first ones and a second series 131 connected to the other side of the panels by third fold lines 132, the said series of flaps being intended to constitute the other two opposing lateral borders of the cover after folding and glueing.

Frangible or slotted regions 133 of the type of the invention are provided straddling and in the middle of the lines 128.

A band 134 is glued on either side of the slots on the panels 127 and extends freely in contact with and opposite the regions and the central part, situated between the slots, of the panel 126.

In one embodiment of the invention, be it either for a carton or a cover, the length of the handle or of the band constituting it can be larger than the distance existing between the points or regions of fixing on either side of the slots, the band then being folded up on itself, pleated, and held flat for example by light glueing of two opposite faces of the pleated band, this so as to increase in particular the space between the upper face of the carton or of the cover, and the deployed handle. This can also facilitate the release of the handle by the user when the latter grasps it.

FIGS. 29 and 30 show the use of the handle system 135 according to the invention applied to a conventional American carton 136, delivered preglued and flat (FIG. 29), and which it suffices to erect by folding up the flaps 137 and 138 whilst nesting them one under the other in a manner known per se, to form the bottom and/or the cover 139.

Such a carton is for example formed from the blank with prepared handle of the type described with reference to FIG. 27.

We claim:

1. A carton formed from sheet material, comprising:

first and second opposed lateral faces;

an upper face connected between said first and second lateral faces along first and second fold lines, respectively;

an elongate handle having first and second ends, said first end being fixed at a first fixation point to an outer surface of said first lateral face, and said second end being fixed at a second fixation point to an outer surface of said second lateral face;

first and second slotted regions defined respectively astride said first and second fold lines, each of said slotted regions extending on either side of the respective one of said fold lines into said upper face and into the respective one of said lateral faces;

said handle being fixed to said lateral faces beneath said slotted regions and disposed along outer surfaces of said lateral and upper faces to extend over said slotted regions and the portion of said upper face disposed between said slotted regions, whereby upon pulling of said handle in a direction substantially perpendicular to said upper face, portions of said handle move into said slotted regions.

2. A carton according to claim 1, wherein said handle is a flexible band.

3. A carton according to claim 1, wherein said handle is fixed to said lateral faces by gluing.

4. A carton as claimed in claim 1, wherein said handle has a length between said first and second fixation points substantially equal to the sum of the lengths along said faces from said first fixation point to said first fold line, said first fold line to said second fold line, and said second fold line to said second fixation point.

5. A carton according to claim 1, wherein said upper face is perpendicular to said first and second faces.

6. A carton according to claim 1, wherein said slotted regions are slot-forming notches defined into said faces.

7. A carton according to claim 1, wherein said first and second slotted regions are substantially identical.

8. A carton according to claim 1, wherein said slotted regions each define rectangular elongate slots oriented in the direction perpendicular to said fold lines.

9. A carton as defined in claim 1, wherein each of said slotted regions define a central part for forming a central slit extending across a respective one of said fold lines, and first and second widened parts defined at each end of said central slit, said widened parts being symmetrical with respect to said fold line.

10. A carton according to claim 9, wherein said central slit is triangular, having a vertex pointing towards said upper face.

11. A carton according to claim 9, wherein said central slit defines a pair of concave sides having radii of curvature pointing outwardly from said slit.

12. A carton according to claim 9, wherein said central slit is rectangular.

13. A carton according to claim 9, wherein said first and second widened parts are each defined by a transverse slit disposed perpendicular to said central slit.

14. A carton according to claim 9, wherein said first and second widened parts are each defined substantially by an isosceles triangle having a large base pointing outwardly from said slotted region.

15. A carton according to claim 9, wherein said central part includes a third widened portion defined astride said fold line.

16. A carton according to claim 1, wherein said first and second slotted regions each extend from said fold line into said upper face to a first end border at a distance a, and extend from said fold line into said lateral face to a second end border at a distance b, and wherein a and b are related as:

$$\frac{1}{4} \leq a \leq 4b.$$

17. A carton according to claim 1, further comprising at least one additional lateral face interconnected with said first and second lateral faces, wherein said carton defines a polygonal horizontal cross-section.

18. A carton according to claim 17, wherein said upper face comprises first and second outer flaps, said first outer flap being connected along said first fold line to said first lateral face, said second outer flap being connected along said second fold line to said second lateral face, and an inner flap connected to each of said additional lateral faces along an additional fold line.

19. A carton according to claim 1, wherein the sheet material is corrugated board.

20. A carton according to claim 19, wherein said corrugated board includes corrugations disposed perpendicular to said first and second fold lines.

21. A carton according to claim 1, wherein said carton is formed from a single, unitary blank.

22. A carton according to claim 1, wherein said carton is formed from a supporting tray and a cover secured thereto, said first and second faces and said upper face being formed within said cover.

23. A blank of sheet material for forming into a carton, comprising:

a series of rectangular panels interconnected by a series of first parallel fold lines;

a series of flaps connected along one side of said series of panels by a plurality of second fold lines to at least some of the rectangular panels, for forming an upper face for the carton;

first and second slotted regions defined respectively astride two of said second fold lines, said first slotted region extending on either side of the respective one of said second fold lines into one of said rectangular panels and into the one of said flaps adjacent thereto, and said second slotted region extending on either side of the respective one of said second fold lines into a non-adjacent one of said rectangular panels and into the one of said flaps adjacent thereto;

each of said slotted regions defining a central part for forming a central slit extending across a respective one of said fold lines, and first and second widened parts defined at each end of said central slit.

24. A blank according to claim 23, wherein said widened parts are symmetrical with respect to said fold line.

25. A blank according to claim 23, wherein said central slit defines a pair of concave sides having radii of curvature pointing outwardly from said slit.

26. A blank according to claim 23, wherein said central slit is rectangular.

27. A blank according to claim 23, wherein said first and second widened parts are each defined by a transverse slit disposed perpendicular to said central slit.

28. A blank according to claim 23, wherein said first and second widened parts are each defined substantially by an isosceles triangle having a large base pointing outwardly from said slotted region.

29. A blank according to claim 23, wherein said central part includes a third widened portion defined astride said fold line.

* * * * *